US010269463B2

(12) United States Patent
Choi et al.

(10) Patent No.: US 10,269,463 B2
(45) Date of Patent: Apr. 23, 2019

(54) NUCLEAR THERMIONIC AVALANCHE CELLS WITH THERMOELECTRIC (NTAC-TE) GENERATOR IN TANDEM MODE

(71) Applicant: United States of America, as represented by the Administrator of the National Aeronautics and Space Administration, Washington, DC (US)

(72) Inventors: Sang Hyouk Choi, Poquoson, VA (US); Kunik Lee, Fairfax, VA (US)

(73) Assignee: The United States of America as represented by the Administrator of NASA, Washington, DC (US)

( * ) Notice: Subject to any disclaimer, the term of this patent is extended or adjusted under 35 U.S.C. 154(b) by 481 days.

(21) Appl. No.: 15/014,608

(22) Filed: Feb. 3, 2016

(65) Prior Publication Data

US 2016/0225476 A1 Aug. 4, 2016

Related U.S. Application Data

(60) Provisional application No. 62/111,286, filed on Feb. 3, 2015.

(51) Int. Cl.
*G21H 1/04* (2006.01)
*G21H 1/10* (2006.01)

(52) U.S. Cl.
CPC ..... *G21H 1/103* (2013.01); *G21H 1/04* (2013.01); *G21H 1/10* (2013.01); *G21H 1/106* (2013.01)

(58) Field of Classification Search
CPC G21H 1/04; G21H 1/10; G21H 1/103; G21H 1/106
See application file for complete search history.

(56) References Cited

U.S. PATENT DOCUMENTS

2008/0272680 A1* 11/2008 Perreault ..... G21H 1/04 313/54
2013/0125963 A1* 5/2013 Binderbauer ..... G01T 1/28 136/253

* cited by examiner

*Primary Examiner* — Ramon M Barrera
(74) *Attorney, Agent, or Firm* — Jennifer L. Riley; Andrea Z. Warmbier; Mark P. Dvorsack

(57) ABSTRACT

Systems, methods, and devices of the various embodiments described herein enable an energy conversion system comprising a radioactive element for generating conduction-band electrons in an avalanche cell and generating heat, wherein the conduction-band electrons are provided to an anode to generate avalanche cell power, and the heat is provided to a thermoelectric generator to generate thermoelectric power. In an embodiment, the avalanche cell is irradiated with gamma rays, which excite electrons within the avalanche cell, generating a current. In an additional embodiment, the thermoelectric power and avalanche cell power can comprise a dual power system.

20 Claims, 7 Drawing Sheets

| PHOTON ENERGY | DESIGNATION | MEAN FREE PATH (cm) | SHELL max/min | COUPLING MODE |
|---|---|---|---|---|
| 10 MeV | γ-ray | 100000 | NUCLEUS | pn, pp, pe, Cs |
| 3 MeV | γ-ray | 10000 | NUCLEUS | pn, pp, pe, Cs |
| | γ-ray | 1000 | | |
| 1 MeV | γ-ray | 100 | NUCLEUS | pn, pp, pe, Cs |
| 300 keV | γ-ray | 10 | NUCLEUS | pn, pe, Cs |
| 100 keV | γ-ray / HARD X-ray | 1 | K (max) | pe, Cs |
| 30 keV | HARD X-ray | 0.1 | L (max) | pe, Cs |
| 10 keV | HARD X-ray | 0.01 | M (max) | pe, Cs |
| | HARD X-ray | 0.001 | | |
| 3 keV | SOFT X-ray | 0.0001 | N (max) | pe, Cs |
| 1 keV | SOFT X-ray | 0.00001 | O (max) | pe, Cs |

FIG. 2

NUCLEAR THERMIONIC AVALANCHE CELLS WITH THERMOELECTRIC (NTAC-TE) GENERATOR IN TANDEM MODE

CROSS-REFERENCE TO RELATED PATENT APPLICATION(S)

This patent application claims the benefit of and priority to 62/111,286, filed on Feb. 3, 2015, the contents of which are hereby incorporated by reference in their entirety.

STATEMENT REGARDING FEDERALLY SPONSORED RESEARCH OR DEVELOPMENT

The embodiments described herein were conceived in the performance of work under a NASA contract or cooperative agreement and by an employee of the United States Government and is subject to the provisions of Public Law 96-517 (35 U.S.C. § 202) and may be manufactured and used by or for the Government for governmental purposes without the payment of any royalties thereon or therefore. In accordance with 35 U.S.C. § 202, the contractor or cooperative agreement recipient elected not to retain title.

BACKGROUND OF THE INVENTION

The present invention relates to direct energy conversion systems and more particularly to methods of converting the emission energy of radioactive decay into a useful energy. Current direct energy conversion systems are based on photovoltaic processes of a single photon to a single electron transfer within the valence band, thermoelectrics of thermally agitated electrons, fuel cells of chemically deprived electrons, or magnetohydrodynamic generators of electrons in free-to-free transition. These systems have respective intrinsic limits to generate a number of useful electrons for power conversion since these systems use the electrons in the valence band. Accordingly, the overall energy density of current direct energy conversion systems is intrinsically poor.

Some types of systems that use radioactive decay processes, such as alpha or beta batteries, are widely mentioned, but the fundamental underlying principles, the technical contents, and the ways to build are not clearly defined. Nuclear batteries or nuclear capacitors have a serious problem with harnessing electrons from the valence band of materials using the unusually low energy capacity of the alpha and beta particles. The energy and number of beta particles emitted from a radioactive decay process are very small, resulting in the conversion systems using these beta particles having very small power densities. Therefore, a nuclear battery subsidizes the beta decay electrons and the alpha particles to generate electron disparity of a p-n junction within the frame of the valence band. Therefore, these nuclear batteries only render a low energy density system.

BRIEF SUMMARY OF THE INVENTION

The systems, methods, and devices of the various embodiments enable an energy conversion system comprising a radioactive element for generating a huge number of electrons undergoing free-to-free transition above the conduction-band in an avalanche cell and generating heat, wherein the electrons above the conduction-band are provided to an anode through a vacuum gap to generate avalanche cell power, and the heat is provided to a thermoelectric generator to generate thermoelectric power. In an embodiment, the avalanche cell material is irradiated with gamma rays, which excite and release a huge number of electrons within the avalanche cell material, generating a large amount of current through a thermionic process in the vacuum gap. In an additional embodiment, the thermoelectric generator and avalanche cell may comprise a dual power system providing thermoelectric power and avalanche cell power.

These and other features, advantages, and objects of the present embodiments will be further understood and appreciated by those skilled in the art by reference to the following specification, claims, and appended drawings.

BRIEF DESCRIPTION OF THE SEVERAL VIEWS OF THE DRAWINGS

The accompanying drawings, which are incorporated herein and constitute part of this specification, illustrate exemplary embodiments, and together with the general description given above and the detailed description given below, serve to explain the features of the embodiments.

FIG. 2 is a table illustrating the relationship between the mean free path of photons in an atomic structure and the photons' energy.

DETAILED DESCRIPTION OF THE INVENTION

Figure 1:
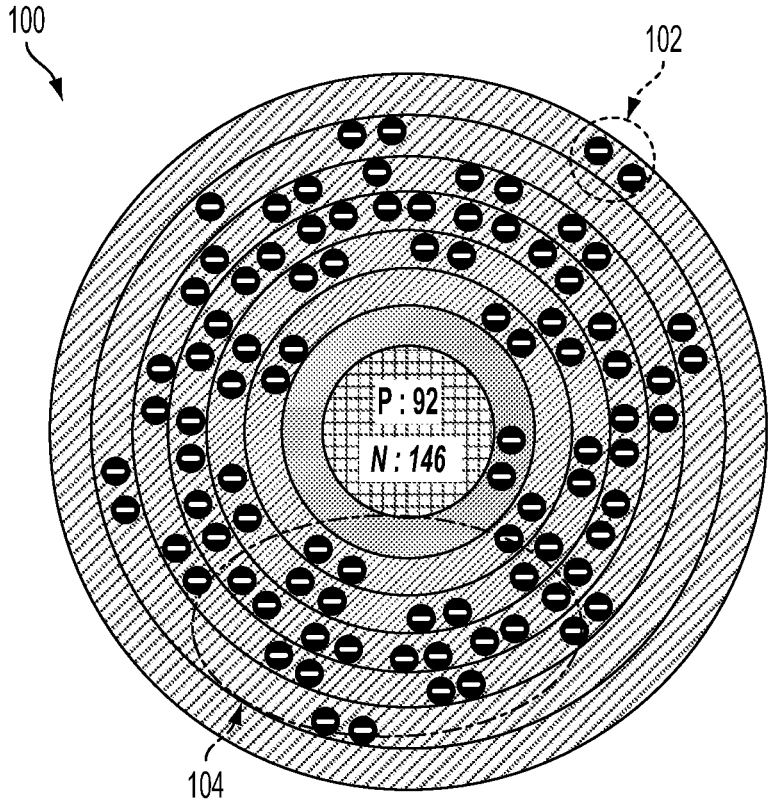
FIG. 1 is block diagram illustrating a cross-section of a model of a typical atom, wherein the potential well of the intra-band electrons greatly exceeds that of the valence band electrons.

For the purposes of the description herein, it is to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The word "exemplary" is used herein to mean "serving as an example, instance, or illustration." Any implementation described herein as "exemplary" is not necessarily to be construed as preferred or advantageous over other implementations.

The various embodiments will be described in detail with reference to the accompanying drawings. Wherever possible, the same reference numbers will be used throughout the drawings to refer to the same or like parts. References made to particular examples and implementations are for illustrative purposes, and are not intended to limit the scope of the embodiments or the claims.

Current arts of direct energy conversion systems have intrinsic limits to generate a number of useful electrons, such as a limit of up to 3 Coulomb/cm$^3$ ("C/cm$^3$") only for power conversion, because these systems are only able to tap a maximum of three electrons in the valence band. Accordingly, the overall energy densities of the conventional conversion systems are intrinsically poor and low.

The various embodiments provide an energy conversion device referred to herein as "Nuclear Thermionic Avalanche Cell (NTAC)." The various embodiments use a relatively huge (in comparison to the maximum three electrons in the valence band used by current systems) number of intra-band (of inner-shell) electrons to generate up to $10^5$ C/cm$^3$ through the bound-to-free quantum level transitions of intra-band (of inner shell) electrons and the reordering process of a shaken nucleus under the impacts of ultrahigh energy multi-photons, such as X-rays and gamma rays (i.e., γ-rays). These phenomena are inversely well-explained by the emission spectra of X-rays and gamma rays when the intra-band electrons are shaken and undergo a population inversion process of quantum level transitions. The embodiment NTAC concept uses a heavy collection of freed-up energetic electrons, such as $10^3$~$10^5$ C/cm$^3$, for power generation through thermionic processes. The freed-up electrons are highly energetic such that only thermionic processes can maximize their transmission across the vacuum-gap. Since this huge number of free electrons obtained through X-ray or gamma ray driven quantum transition is directly pulled across the vacuum-gap and utilized for power generation using thermionic process, the embodiment NTAC systems may result in an ultrahigh power density, such as power density greater than 1 kW/cm$^3$.

Exothermic nuclear reactions through decay, fission, and fusion generate tens of kilo- to mega-electron volt (keV-~MeV) level X-ray and gamma ray photons. Most decay processes of radioactive materials involve the emission of gamma rays as described below:

$$^{60}Co_{27} \rightarrow {}^{60}Ni^{*}_{28} + e^{-} + \hat{U}_{e} + \gamma[1.17\ MeV] \rightarrow {}^{60}Ni_{28} + \gamma$$
$$[1.33\ MeV]$$

Accordingly, in an embodiment, a radioactive material that generates gamma rays while decaying may be an energy source for the NTAC. A half-life of some of radioactive material in a decay process spans several tens to hundreds of years. Thus, a single charge of fuel for an embodiment NTAC may enable the NTAC to run for tens or hundreds of years without refueling. In an embodiment, refined nuclear waste may serve as a convenient γ-ray source.

The various embodiment ultrahigh power density and longtime operational energy conversion systems will set a new paradigm for (1) space exploration with the benefits of increased high power capacity and new electric propulsion, (2) electric aero-propulsion, (3) terrestrially replacing batteries of electric vehicles, (4) autonomous power units for residential power needs, which may eliminate power network with crisscrossed transmission lines, and (5) electric propulsion of surface ship and submarines.

FIG. 1 is a cross-section of a Uranium isotope atom 100. The conventional energy conversion systems that rely on the valence band electrons 102 of an atomic structure can only utilize a relatively small electron potential well. FIG. 1 shows two valence electrons 102, but the conventional energy systems may extract from the valence band at most 3 C/cm$^3$ or $5\times10^2$ C/kg.

In comparison, the various embodiments presented herein take advantage of the intra-band electrons 104 in addition to the valence band electrons 102, enabling the generation of greater than 3 C/cm$^3$ or $5\times10^2$ C/kg. Specifically, various embodiments utilize the great difference between intra-band electron potential wells and the valence band electron potential wells. The intra-band electron potential well for the lanthanides, for example Lanthanum with an electron population in its shells of (2, 8, 18, 18, 9, 2), can be estimated by counting the electron population at the three outer-most shells, such as the population in each of those shells of (18, 9, 2) which results in a total of 29. Considering the molar weight (139 g/mol) and density (6.162 g/cm$^3$) of lanthanum, the number density of lanthanum atoms is $4.33\times10^{21}$/g or $2.67\times10^{22}$/cm$^3$. The number density of electrons in the intra-band potential well amounts to be $7.74\times10^{23}$/cm$^3$, which is equivalent to 124,042 C/cm$^3$ ($\approx10^5$ C/cm$^3$ or ~$10^7$ C/kg). As opposed to this result, the energy conversion process using valence band electrons shows why it is almost impossible to have high energy densities in conventional systems. Because the extremely high-potential well can be directly translated into high energy density conversion systems by the availability of a huge number of intra-band electrons, the various embodiments may be 5 orders of magnitude higher in energy density than the conventional systems.

FIG. 2 shows the mean free path of gamma ray photons with associated coupling modes of interaction. As shown in FIG. 2, the soft X-rays (~1-3 keV) and hard X-rays (~10-30 keV) only couple to electrons via the photoelectric (pe) and Compton scattering (Cs), and lack the energy to penetrate through the electron orbitals to the nucleus. However, high energy photons, such as gamma ray photons, may also interact via the photonuclear effect (pn) and pair production (pp), in addition to the photoelectric (pe) and Compton scattering (Cs). Unlike the mean free paths of soft and hard X-rays, the mean free paths of the high energy photons, such as gamma ray photons, are large enough to allow the high energy photons to reach and even interact with the nucleus of an atom.

The coupling interactions of gamma ray photons are extremely violent and excite the shell electrons from their probability space and nucleus. These phenomena can be explained by four main processes: the photoelectric (pe) and photonuclear (pn) effects, Compton scattering (Cs), and electron/positron pair production (pp). Low-energy photons can cause electrons in the valence band to undergo a bound-to-free transition through the photo-electric (pe) effect, while the higher energy photons may interact with electrons in the intra-bands or inner-shells or with the nucleus to develop Thomson or Compton scattering and/or pair production. As a gamma ray penetrates matter, the energy deposited by absorption is proportional to the absorption cross-section ($\sigma_t=\sigma_C+\sigma_{pe}+\sigma_{pn}+\sigma_{pp}$), the atomic weight of matter (Z), and the thickness. The interaction of gamma photons with atomic intra-band electrons through any of the photoelectric, photonuclear, Compton scattering, and pair production processes deposits enough energy to produce and sustain the secondary and tertiary electrons as an avalanche process.

In short, the physical phenomena of gamma ray photon interactions with atomic structure may be summarized as follows:

Photoelectric (pe) effect (Low energy phenomenon): Wave-packet (hν) quantization of electrons; $E_K=\hbar(\nu-\nu_o)$, where $\nu>\nu_o$ for free transition and thermalization (β particles).

Photonuclear (pn) effect (High energy phenomenon): Wave-packet (hv) quantization of atomic nucleus; emission of subatomic particles (proton, neutron, or a particles) and shaking up of electronic shell structures.

Compton scattering (Cs) (Mid energy phenomenon): Inelastic scattering of a photon by a free charged particle causes the energy of the photon to decrease $$\lambda - \lambda_o = \frac{h}{m_e c}(1 - \cos\theta)$$

(β-thermalized).

Electron/Positron pair production (pp) (High energy phenomenon): As a high energy photon interacts with a nucleus, the energy of this photon is converted into mass. Without a nucleus to absorb momentum, the photon decays into an electron-positron pair $\gamma+\gamma \rightarrow e^- + e^+$.

Figure 3:
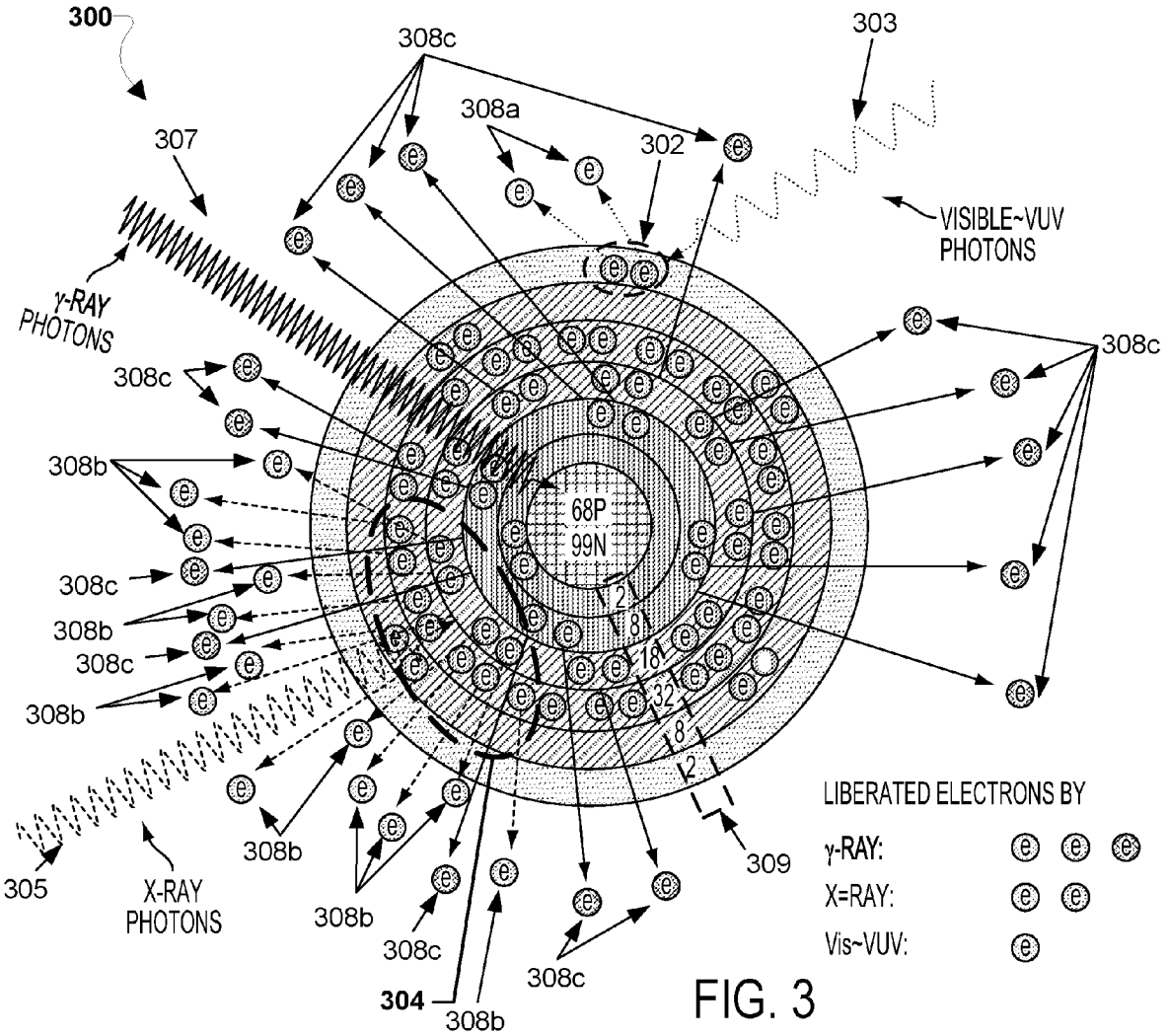
FIG. 3 is a block diagram illustrating a cross-section of a model of a typical atom and illustrates the interactions of photons of various energies with bound electrons and an atomic nucleus.

FIG. 3 shows a simple interaction model of visible through vacuum UV photons 303, X-ray photons 305, and gamma ray photons 307 with atomic electrons. The number of electrons in each shell is given in box 309. The visible through vacuum UV photon 303 carries just enough energy to release the valence band electrons 302 from a bound state to a free state 308*a*. An X-ray photon 305 may be strong enough to penetrate into the inner-shells of atom and shake up and release intra-band electrons 304 from their bound states to a free state 308*b*. Extremely strong gamma ray photons 307 can even penetrate and shake up the nucleus 306 and make all electrons of the atom unstable enough to undergo a bound-to-free transition. After bombardment by gamma ray photons 307, the electrons in the inner-most shells almost instantaneously undergo a recombination process through a free-to-bound transition by releasing equivalent photon energy. This free-to-bound transition induces spontaneous photon emission with equivalent energy of the excited state. These emitted photons from the recombination process interact with and energize those electrons which are already in unstable or free states, further releasing more electrons from the outer shells of an atom 308*c*.

The interaction processes of intra-band electrons 304 within an atomic inter-shell structure described above are generally instantaneous and localized within the atomic structure 300. The frequency of interactions is heavily dependent upon the coupling cross-section of the intra-bands electrons 304 and the energy and flux density of the X-ray photons 305 or gamma ray photons 307. Unless the gamma ray photons 307 continuously bombard the atomic structure 300, the intra-band electrons 304 recoil and undergo an inter-band recombination process (free-to-bound) approximately within a zepto second ($zs \approx 10^{-21}$ sec) which is inversely proportional to the intra-band gap energy ($\tau \sim 1/E$). The intraband upper lifetime is extremely short due to the large scale of bound energy. However, because of the continuous interaction processes of X-ray photons 305 or gamma ray photons 307 with atomic electrons, the avalanche state of a huge number of free electrons 308*a-c* ($10^5$ C/cm$^3$) may be sustained for thermionic processes. These electrons in an avalanche state are further interacted with and thermalized by lower-energy gamma ray photons 307 through the pe, the Cs, the pp, and emitted photons through the recombination process. Such a thermalization process of electrons increases the kinetic energy of electrons and slows down the recombination (free-to-bound) process.

Figure 4:
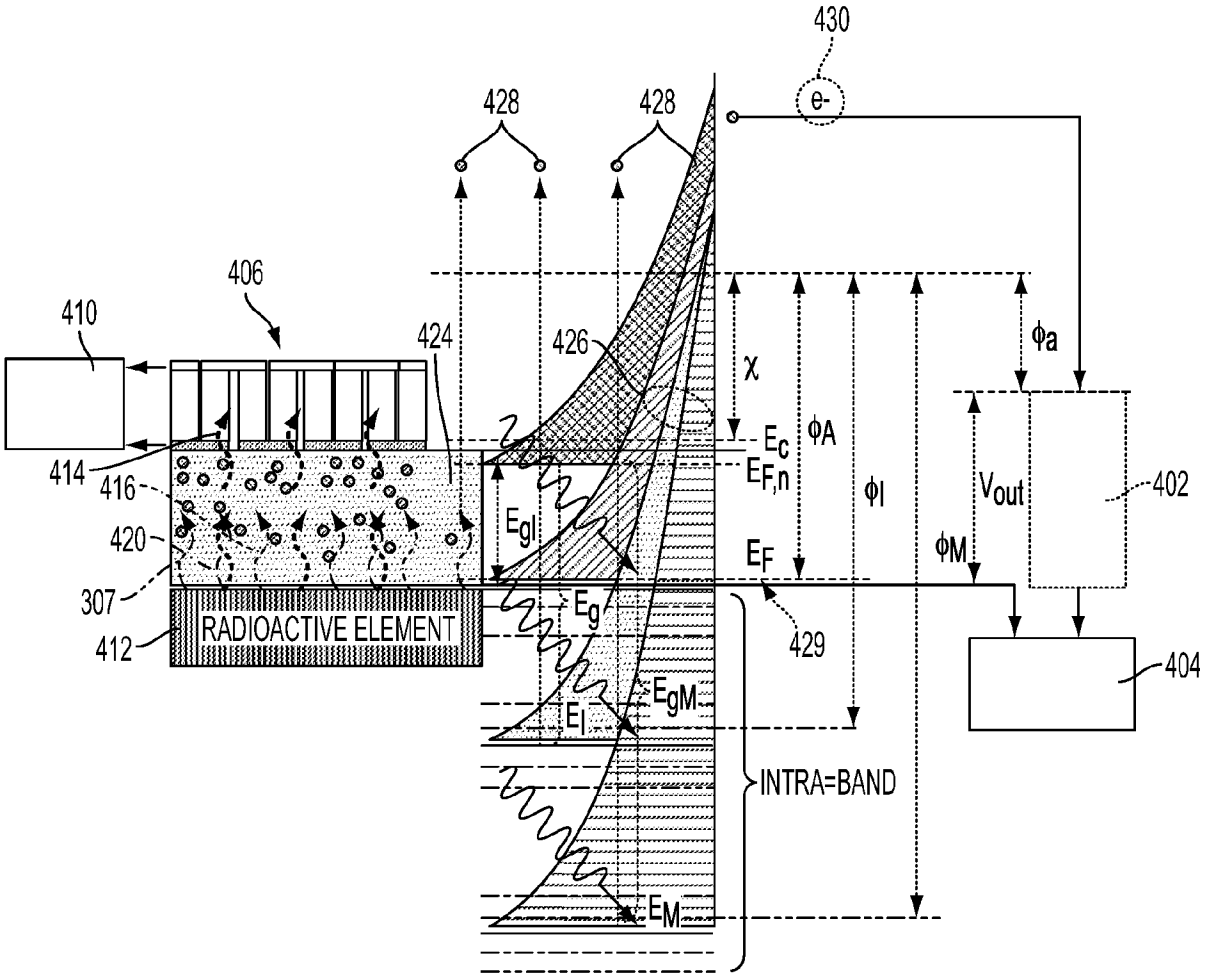
FIG. 4 is an energy diagram illustrating the transition levels by the interplay between electron-photon interactions, electron energy, and the tandem system of nuclear thermionic avalanche cells (NTAC) coupled with a thermoelectric (TE) generator.

FIG. 4 illustrates the relationship and level transitions between the energy of the atomic electrons, the atomic structure, such as atomic structure 300 described above, and the physical layout of an embodiment dual power system, comprising a nuclear thermionic avalanche cell (NTAC) 424 and thermoelectric (TE) generator 406. The emission of intraband electrons (bound-to-free transition) and subsequent thermalization (free-to-free transition) 426 of electrons may be two step processes combined for a level transition 428. The electrons removed from their probability space by X-ray or Gamma ray photons undergo a transition from the intraband to the conduction band ($E_F$) 429 and the electrons at or above the conduction band 429 undergo a free-to-free transition as thermalized 426 by the interaction with the lower-energy gamma ray photons 307 through the pe, the Cs, the pp, and emitted photons through the recombination process. In an embodiment, emissions from radioactive element 412 may comprise gamma rays 307, alpha particles 420, beta particles 416, and thermal waves 414. The emission spectra from radioactive element 412 may be directed to impinge on the material for NTAC 424. The radiation emissions from radioactive element 412 may then thermalize electrons 426 through interaction processes described above. These processes may also lead to a gamma-ray enhanced electron population 428 comprising photoexcited electrons. Sufficiently excited electrons such as electron 430 may be guided to anode 402 where they are converted to useful avalanche cell power 404. Meanwhile, the thermal waves 414 from the radioactive element 412 may be absorbed by the TE generator 406 and generates output in the form of useful thermoelectric power 410.

The radiation-enhanced thermalized avalanche thermionic emission ("RETATE") can be estimated by considering the flux of photoexcited electrons, such as electrons comprising the gamma ray enhanced electron population 428, and thermalized electrons 426 that have sufficient energy to escape the material surface in a vacuum. The flux of electrons is the collection of electrons freed up from the deep-level and intra-band photo excitations by a gamma ray photon 307 of MeV-level energy. The electron population in the conduction band is distributed by the quasi-Fermi level in the aftermath of the level transitions from the deep and intra-bands. The electrons freed from the deep and intra-bands, $\Sigma E_i$, are simultaneously populated above the level of the conduction band minimum, $E_C$, and gain further energy through thermalization and photoexcitation processes.

By modifying a non-degenerate semiconductor model for the thermionic emission of electrons freed from the deep and the intra-bands, the Fermi energy of electrons is expressed by $$E_{F,n} = E_F + \Sigma_i E_i + \kappa T_C \Sigma_i \ln(n_i/n_{eq}) \quad (1)$$

where $E_F$ is the Fermi level, $E_i$ is the Fermi level of intra-band, $n_i$ is the total freed-up electron concentration in the conduction band from the intra-band, $n_{eq}$ is the equilibrium concentration without photoexcitation, and $T_C$ is the cathode temperature. The above expression indicates that the photoexcitation by gamma rays abundantly multiplies electron concentration at the conduction band additively from the valence band and intra-bands, $\Sigma E_i$. The third term of Equation (1) represents the energy contribution from the thermalized electrons at the conduction band.

Assuming that the freed-up electrons are collected by the cathode. The total current density can be expressed by $$J_C = \sum_i \left( \int_{E_C+\chi}^{\infty} e v_{ix} N(E_i) f(E_i) dE_i \right) = \quad (2)$$

-continued $$\sum_i \left[ \int_{E_C+\chi}^{\infty} e v_{ix} \left( \frac{4\pi(2m^*)^{\frac{3}{2}}}{h^3} \right) \sqrt{E_i - E_C} \cdot \exp\left( \frac{-E_i + E_{F,n}}{\kappa T_C} \right) dE_i \right]$$

where $E_C$ is the energy at the conduction-band minimum, $\chi$ the electron affinity, e the electron charge, $v_{ix}$ the electron velocity perpendicular to the material surface, $N(E_i)$ the density of i states, $f(E_i)$ the Fermi distribution, m* the effective mass, and i=F, I, M, . . . (i.e. valence and intra-bands). The expression on the right hand side of Equation (2) assumes that the density of states in the conduction band is parabolic and approximates the Fermi function by the Boltzmann distribution because the work function is much larger than $\kappa T_C$.

$$J_C = \sum_i \left( \int_{E_C+\chi}^{\infty} e v_{ix} N(E_i) f(E_i) dE_i \right) = \sum_i \left[ \int_{E_C+\chi}^{\infty} e v_{ix} \left( \frac{4\pi(2m^*)^{\frac{3}{2}}}{h^3} \right) \sqrt{E_i - E_C} \cdot \exp\left( \frac{-E_i + E_c - E_c + E_{F,n}}{\kappa T_C} \right) dE_i \right] \tag{2a}$$

Assume that the effective mass is isotropic. Then under both the thermalization and the photoexcitation processes of electrons above the conduction-band minimum, electrons gain excessive degree of freedom with kinetic variation, such as $\Sigma E_i - E_C = \Sigma(m^* v_i^2/2)$, where $v_i^2 = v_{ix}^2 + v_{iy}^2 + v_{iz}^2$. We can rewrite the integral in terms of electron velocities:

$$J_C = 2e\left(\frac{m^*}{h}\right)\exp\left[\frac{-(E_C - E_{F,n})}{kT_c}\right] \cdot \sum_i \left\{ \int_0^{\infty} dv_{iy} \int_0^{\infty} dv_{iz} \int_{v_{vac}}^{\infty} dv_{ix} v_{ix} \cdot \exp\left( \frac{m^* v_i^2}{2kT_C} \right) \right\} \tag{3}$$

where $v_{vac} = \sqrt{2\chi/m^*}$ is the minimum velocity necessary for an electron to escape into the vacuum. The excitation and thermalization processes of electrons require substantially more energy than the bandgap energy ($E_{gI} \ldots E_{gM}$) for even deep level transitions. The incident gamma-rays 307 or high energy alpha particles 420 and beta particles 416 increase the electron population by both thermalization and photon-coupling above the conduction band minimum. These photo-excited and thermalized electron populations 428 are effectively freed up to undergo a free-to-free transition away from band-gap structures ($E_g$, $E_{gI} \ldots E_{gM}$) of materials and exist in an open domain as a dark current. Therefore, the potential gap of the electron population is further increased beyond the electron affinity, $\chi$, to allow electrons to migrate to the vacuum. The energies for level transitions can be expressed by the summation of bound-to-free ($E_C$) and free-to-free transitions such as $E_C+\chi$ which is equal to $E_F+\phi_A$ for valence band, $E_I+\phi_I=E_C+\chi$(Intra-band), and $E_M+\phi_M=E_C+\chi$(Intra-band). Within the bandgap structures, $E_C$ can be expressed with the bandgap energy ($E_g$) on top of the Fermi energy at valence band and the Fermi energies ($E_{gI} \ldots E_{gM}$) for intra-bands. Since the conduction-band minimum ($E_C$) is within the free-to-free transition regime, $E_C \geq E_F + E_g$ for valence band and $E_C \geq E_I + E_{gI}$ and $E_C \geq E_M + E_{gM}$ for the intra-bands. Therefore, the work functions ($\Sigma\phi_I$) of the system is determined by $\phi_A \geq E_g + \chi$ for valence band or $\phi_I \geq E_{gI} + \chi$ and $\phi_{gM} \geq E_{gM} + \chi$ for intra-bands.

Significantly, Equation (3) yields a result that is identical to the Richardson-Dushman equation for thermionic current, except that the energy barrier in the exponent is relative to the quasi-Fermi level instead of the equilibrium Fermi level:

$$\begin{aligned} J_C &= \left(\frac{4\pi e m^* k^2}{h^3}\right) T_C^2 \cdot \sum_i \left\{ \exp\left[ \frac{-(E_C - E_{F,n} + \chi)}{kT_C} \right] \right\} \\ &= A T_C^2 \cdot \sum_i \left\{ \exp\left[ \frac{-(\phi_i - (E_{F,n} - E_F))}{kT_C} \right] \right\} \\ &= A T_C^2 \cdot \sum_i \left\{ i \cdot \exp\left[ \frac{-\chi}{\kappa T_C} \right] \right\} \end{aligned} \tag{4}$$

where A is the Richardson-Dushman constant. The expression on the right hand side of Equation (4) explicitly shows that the effect of photo-illumination on semiconductor thermionic emission is to lower the energy barrier by the difference between the quasi-Fermi level with photoexcitation and the Fermi level without photoexcitation. Such an effect exists for deeper Fermi levels as expressed in Equations (1) and (4). Rewriting the Equation (4) in terms of the electron density in the conduction band, $n_i$, and average velocity perpendicular to the surface, $\langle v_{ix} \rangle$, leads to an ejection of electrons as $$J_C = \sum_i \left\{ e n i \langle v_{ix} \rangle \cdot \exp\left[ \frac{-\chi}{\kappa T_C} \right] \right\} \tag{5}$$

Equation (5) illustrates the number of electrons excited by the photo-coupling process which increases conduction-band electron concentration n over the equilibrium value $n_{eq}$, whereas the thermal energy determines the rate at which electrons emit over the electron affinity $\chi$.

Through the avalanche process of electron generation, electrons may be directed with proper potentials that inhibit electron recombination. In an embodiment, direct energy conversion of these high energy electrons created by gamma ray photons, such as gamma ray photons 307, may utilize several specific designs of material morphologies, such as nanostructures of high Z materials (e.g., high atomic number or number of proton materials). These designs may allow for the rapid thermionic emission of avalanche electrons into a conversion route over the mean free path of energetic electrons before the energetic electrons lose their kinetic energy and eventually recombine. In an embodiment illustrated in FIG. 5, the energetic avalanche electrons originating from the intra-bands may gather in vacuum thermionic emitter 502 and eventually cross over the potential gap in the vacuum. The vacuum potential gap of the thermionic emitter 502 may be determined by the materials of the emitter, the vacuum pressure, the gap distance, and the direct gap voltage.

Figure 5:
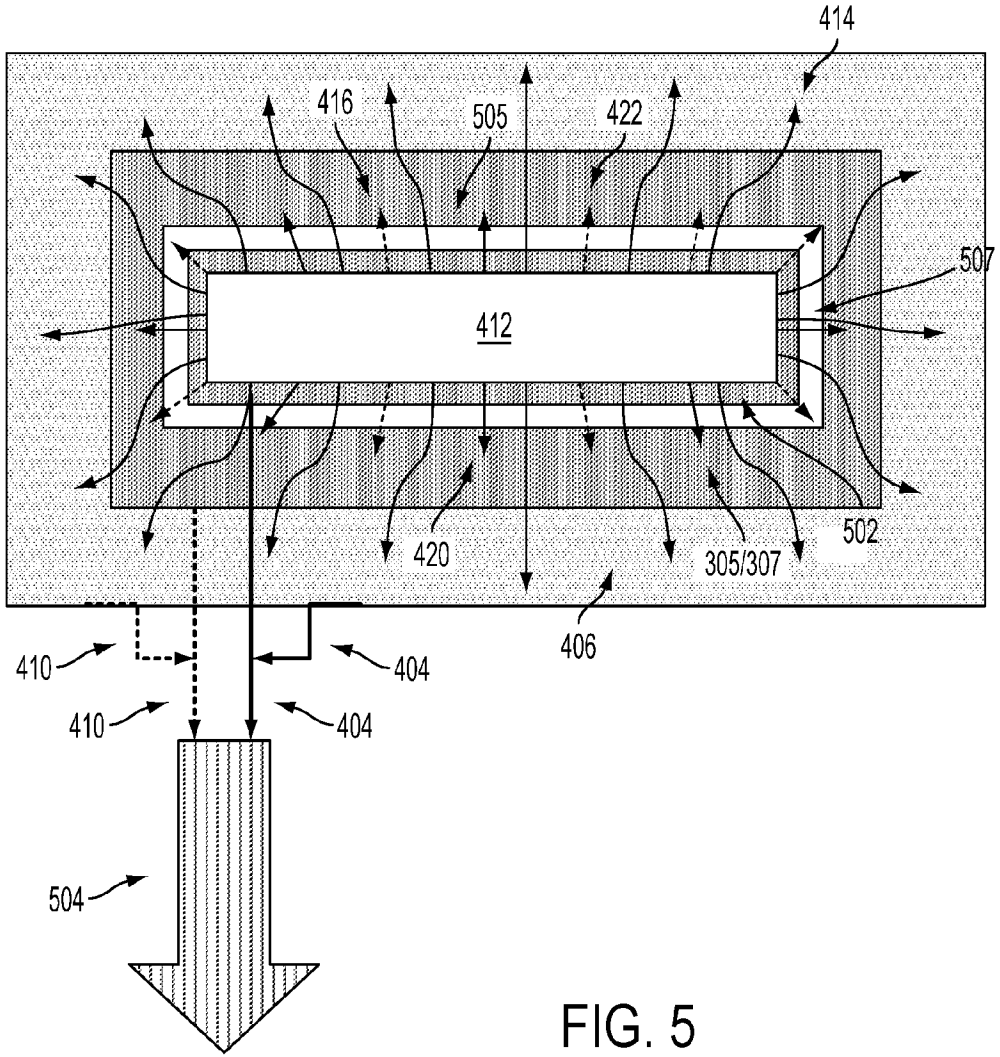
FIG. 5 is a block diagram of a tandem model of nuclear thermionic avalanche cell (NTAC) coupled with a thermoelectric (TE) generator.

In an embodiment shown in FIG. 5, radiation source 412 may emit alpha particles 420, beta particles 416, photons such as X-rays 305 and gamma rays 307, muon particles 422, and thermal waves 414. As discussed above in relation to FIG. 4, the thermal waves 414 may be used in a TE generator 406 to generate thermoelectric power 410. Concurrently, emitted particles 420, 416, 305, 307, and 422 may excite avalanche electrons in NTAC to high energy levels. The energetic avalanche electrons may gather in vacuum gap 507 before escaping, upon which they may be used to generate avalanche cell power 404. In an embodiment, the avalanche cell power 404 and thermoelectric power 410 may be further utilized in concert as tandem power source 504. For example, an anode 505 of the NTAC and a thermionic emitter (or cathode) 502 of the NTAC, as well as an anode of the TE generator 406 and a cathode of the TE generator 406, may be connected to a direct current (DC) bus to provide both the avalanche cell power 404 and thermoelectric power 410 together and/or individually, to the DC bus for use by other devices (e.g., conversion to AC power, storage, to power DC devices, etc.) thereby acting as a tandem power source 504.

Figure 6:
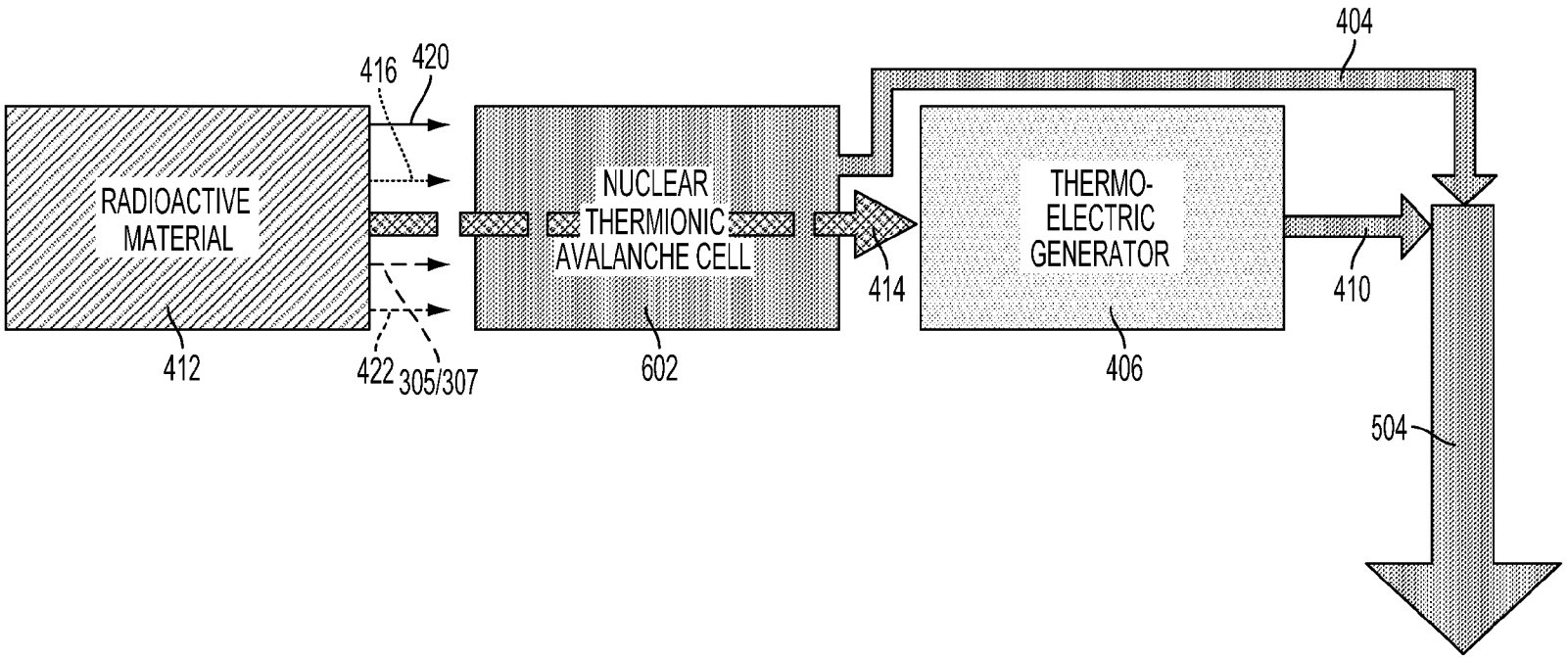
FIG. 6 is a block diagram of a tandem NTAC-TE system.

FIG. 6 further illustrates an embodiment utilizing a dual power system. In an embodiment, the excessive heat generated while radioactive material in radioactive source 412 decays may be used by the TE generator 406. In an embodiment, a tandem energy conversion system consists of a NTAC 602 and a TE generator 406. As described above, the radioactive source 412 may emit alpha particles 420, beta particles 416, photons such as X-rays 305 and gamma rays 307, muon particles 422, and thermal waves 414. Electrons in the NTAC 602 may be energetically excited and used to generate avalanche cell power 404. Additionally, the thermal waves 414 may be input into the TE generator 406 and output as useful thermoelectric power 410. The avalanche cell power 404 and thermoelectric power 410 may then be combined and used as a complementary power source 504 as part of a dual power system.

Radioactive decay may generate a relatively huge amount of thermal energy (e.g., level>1000° C. by a Plutonium pellet) and at the same time may emanate gamma rays. The TE generators of the various embodiments may convert thermal energy directly into DC power while the nuclear thermionic avalanche cells of the various embodiments convert the high energy gamma ray (>MeV) directly into DC power. The various embodiment energy conversion systems may not require any continually added fuel supply, rather an original loaded radioactive material may last a half century without refueling meaning no replacement (or added) fuel supply may be required for most missions.

Figure 7:
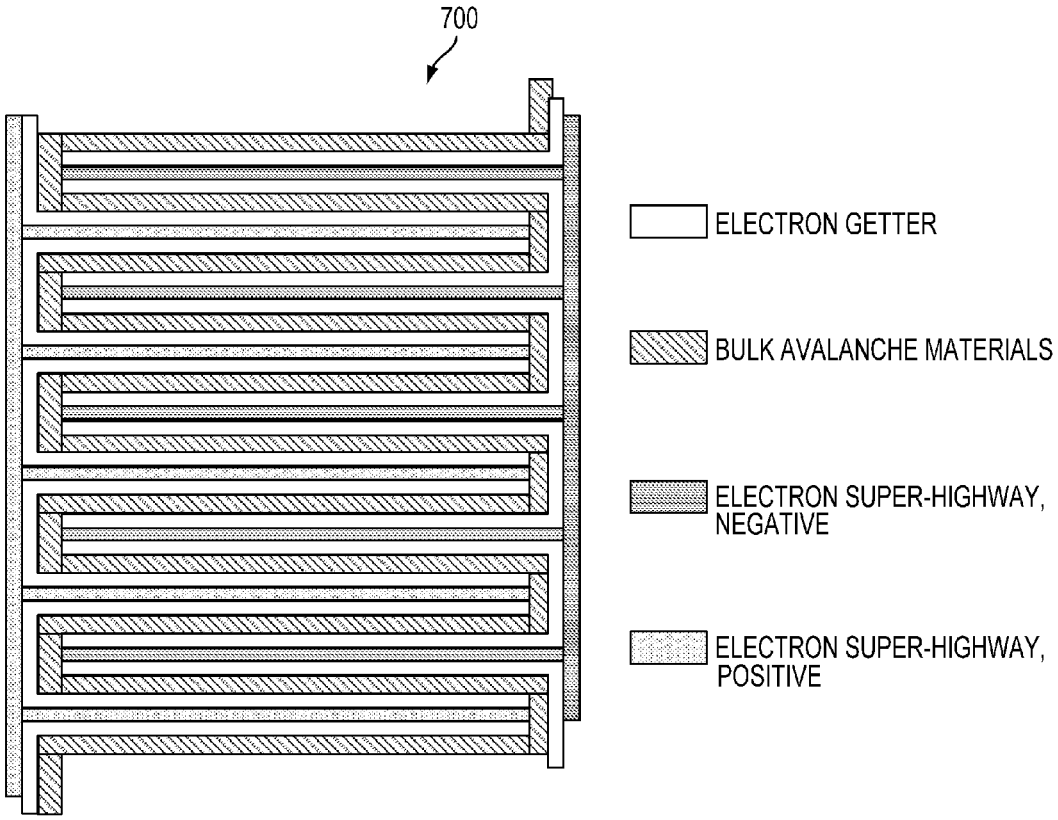
FIG. 7 is a block diagram illustrating an embodiment avalanche cell structure.

FIG. 7 illustrates an embodiment avalanche cell 700. When radioactive particles collide with gold or rare earth elements, a large number of high energy electrons are released and collected by electron getter material of the avalanche cell 700. The electron getter material, such as lithium hydrides, may encompass bulk avalanche materials and pass through the lithium hydride to electrodes, such as quantum-well structures or carbon nanotubes. The avalanche cell 700 is a low loss system because the reaction cross-section of materials, like gold or rare earth elements, is larger than the wavelengths of alpha or beta particles and gamma ray.

Through the avalanche process of those electrons in free-to-free transition, electrons must be directed to cross over the vacuum gap 507 with proper potentials that keeps electrons away from the emitter surface to reduce the probability of recombination. Direct energy conversion of these high energy particles and photons into DC power requires several specific designs of material morphologies, such as nano-structured quantum-well structures or carbon nanotube (CNT) materials, to rapidly funnel out the avalanche electrons into a conversion cycle. Such a quantum-well structure as an electron super-highway allows fast movement of a huge number of electrons within the receptor material and eventually going through the conversion route after crossing the vacuum gap 507. The electrons generated from the bulk thermionic materials may not be funneled out immediately into the electron superhighway due largely to the thermalized random motions of electron within a bulk material. Therefore, the intermediate level electron getters of the avalanche cell 700 act to pick or guide electrons into the electron superhighway. The material of an electron receptor (or getter) 505 may surround the bulk thermionic materials 502 in a nano or micro-scale level comparable to the mean free path of energetic electrons before energetic electrons quickly lose their kinetic energy to slow down and are eventually recombined. The electron getter materials may be morphologically and quantum mechanically simple enough not to create a randomly jittered electron population within itself. However, regardless of the morphological simplicity of electron receptor material 505, the energetic electrons have generally strong kinetic motion to any directions arbitrarily. Accordingly, the electrons that cross over the vacuum gap 507 go all directions and do not perpendicularly arrive at the receptor material 505. In order to capture and collect the energetic electrons which are in all directions, the receptor material 505 surrounds completely the thermionic receptor materials 502 with a vacuum gap 507. The electrons within the electron receptor material 502 may be quickly depleted through the electron super highway without creating an electric potential tensor field. One of the materials for electron receptor 502 may be lithium hydrides.

A further embodiment contemplated for terrestrial and space applications may be the dual energy conversion systems in tandem mode consisting of the NTAC as a primary energy conversion engine and the TE generator with three regenerative cycles combined as a secondary conversion engine. This dual energy conversion system in tandem mode has very long life without refueling for at least 30 years and high energy density from 0.02 $kW/cm^3$ to 1 $kW/cm^3$.

The embodiments described above have many advantages over related art. The embodiments may exhibit a high efficiency, up to 70%. They may be compact and lightweight for convenience. Additionally, a combined cycle may be possible with a radioisotope thermoelectric generator. Also, the embodiments may possess a long life, as no fuel supply is necessary for 30 years after initial fuel loading. As described above, the embodiments may exhibit high power density from 0.02 $kW/cm^3$ to 1 $kW/cm^3$ and 20 times more power than a thermo-electric generator. The dual NTAC-TE generator power system is suitable for deep space explorations, power satellite applications, and aerospace applications, including airships.

The preceding description of the disclosed embodiments is provided to enable any person skilled in the art to make or use the present embodiments. Various modifications to these embodiments will be readily apparent to those skilled in the art, and the generic principles defined herein may be applied to other embodiments without departing from the spirit or scope of the disclosure. Thus, the embodiments shown herein are not intended to be limiting but are to be accorded the widest scope consistent with the following claims and the principles and novel features disclosed herein.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the following claims and the principles and novel features disclosed herein.

All cited patents, patent applications, and other references are incorporated herein by reference in their entirety. However, if a term in the present application contradicts or conflicts with a term in the incorporated reference, the term from the present application takes precedence over the conflicting term from the incorporated reference.

All ranges disclosed herein are inclusive of the endpoints, and the endpoints are independently combinable with each other. Each range disclosed herein constitutes a disclosure of any point or sub-range lying within the disclosed range.

The use of the terms "a" and "an" and "the" and similar referents in the context of describing the invention (especially in the context of the following claims) are to be construed to cover both the singular and the plural, unless otherwise indicated herein or clearly contradicted by context. "Or" means "and/or." As used herein, the term "and/or" includes any and all combinations of one or more of the associated listed items. As also used herein, the term "combinations thereof" includes combinations having at least one of the associated listed items, wherein the combination can further include additional, like non-listed items. Further, the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

Reference throughout the specification to "another embodiment", "an embodiment", "exemplary embodiments", and so forth, means that a particular element (e.g., feature, structure, and/or characteristic) described in connection with the embodiment is included in at least one embodiment described herein, and can or cannot be present in other embodiments. In addition, it is to be understood that the described elements can be combined in any suitable manner in the various embodiments and are not limited to the specific combination in which they are discussed.

What is claimed is:

1. An energy conversion system comprising:

a radioactive material configured to emit high energy photons and thermal waves;

a Nuclear Thermionic Avalanche Cell (NTAC) configured to receive the photons and the thermal waves from the radioactive material and by the received photons free up electrons in an avalanche process from deep and intra bands of an atom to output high density avalanche cell power through a thermionic process of the freed up electrons; and a thermoelectric generator (TE) configured to receive the thermal waves from the NTAC and output thermoelectric power based at least in part on the received thermal waves.

2. The energy conversion system of claim 1, wherein the photons are x-rays or gamma rays.

3. The energy conversion system of claim 2, wherein the radioactive material is radioactive nuclear waste or nuclear fuel.

4. The energy conversion system of claim 3, wherein the output avalanche cell power is generated by the NTAC using a collection of energetic electrons freed-up by the photons at or above $10^3$ C/cm$^3$.

5. The energy conversion system of claim 4, wherein the collection of energetic electrons freed-up by the photons is within a range of $10^3$ C/cm$^3$ to $10^5$ C/cm$^3$.

6. The energy conversion system of claim 1, wherein a thermionic emitter material of the NTAC surrounds the radioactive material and the TE surrounds the NTAC.

7. The energy conversion system of claim 6, wherein the NTAC and the TE are connected to a direct current (DC) bus to output the avalanche cell power and the thermoelectric power in tandem to the DC bus.

8. The energy conversion system of claim 1, wherein the NTAC comprises nanostructures of high Z materials.

9. The energy conversion system of claim 1, wherein a thermionic emitter material of the NTAC comprises a rare earth element supporting liberation of a huge number of electrons.

10. The energy conversion system of claim 1, further comprising a vacuum gap surrounding a thermionic emitter material of the NTAC.

11. The energy conversion system of claim 10, further comprising an electron receptor material surrounding the thermionic emitter material and vacuum gap.

12. The energy conversion system of claim 11, wherein the electron receptor material comprises a quantum-well structure allowing ultrafast mobility of collected electrons through a NTAC power conversion cycle.

13. The energy conversion system of claim 12, wherein the electron receptor material comprises lithium hydride and wherein electrons from the thermionic emitter material cross over the vacuum gap with an applied bias voltage and arrive at the electron receptor material.

14. A method for energy conversion, comprising:

receiving photons and thermal waves emitted from a radioactive material at a Nuclear Thermionic Avalanche Cell (NTAC);

outputting avalanche electrons using in part the received photons;

guiding the avalanche electrons to cross over a vacuum gap to reach a receptor electrode under an applied bias voltage to allow the avalanche electrons received by the receptor electrode to run through a quantum well structure for ultrafast mobility to a power circuit;

receiving the thermal waves from the NTAC at a thermoelectric generator (TE); and outputting thermoelectric power from the TE based at least in part on the received thermal waves.

15. The method of claim 14, wherein the photons are x-rays or the photons are gamma rays.

16. The method of claim 15, further comprising generating the avalanche cell power by the NTAC using a collection of energetic electrons freed-up by the photons at or above $10^3$ C/cm$^3$.

17. The method of claim 16, wherein the collection of energetic electrons freed-up by the photons is within a range of $10^3$ C/cm$^3$ to $10^5$ C/cm$^3$.

18. The method of claim 14, wherein the NTAC and the TE are connected to a direct current (DC) bus, the method further comprising outputting the avalanche cell power and the thermoelectric power in tandem to the DC bus.

19. The method of claim 14, wherein:

the electron receptor electrode comprises a high charge mobility material;

the quantum-well structure is configured as an electron superhighway;

guiding the avalanche electrons to cross over the vacuum gap to reach a receptor electrode under the applied bias voltage to allow the avalanche electrons received by the receptor electrode to run through the quantum well structure for ultrafast mobility to the power circuit comprises guiding the avalanche electrons to cross over the vacuum gap to reach the receptor electrode under the applied bias voltage to allow the avalanche electrons received by the receptor electrode to run through the electron superhighway via the electron receptor electrode for ultrafast mobility to the power circuit; and the avalanche electrons comprise a collection of energetic electrons freed-up by the photons.

20. The method of claim 19, wherein:

the NTAC surrounds the radioactive material and the TE surrounds the NTAC;

the NTAC comprises nanostructures of high Z materials or a rare earth element; and the electron receptor electrode comprises a light and high electron conductive material.

* * * * *